US008939878B2

(12) United States Patent
Takekawa et al.

(10) Patent No.: US 8,939,878 B2
(45) Date of Patent: Jan. 27, 2015

(54) SHEET FOLDING DEVICE AND IMAGE FORMING APPARATUS

(75) Inventors: Kenichi Takekawa, Aichi (JP); Yasuki Matsuura, Nagoya (JP); Masanobu Kimata, Nissin (JP); Isao Yasuda, Nagoya (JP)

(73) Assignee: Ricoh Company, Limited, Tokyo (JP)

( * ) Notice: Subject to any disclaimer, the term of this patent is extended or adjusted under 35 U.S.C. 154(b) by 309 days.

(21) Appl. No.: 12/230,732

(22) Filed: Sep. 4, 2008

(65) Prior Publication Data

US 2009/0062100 A1 Mar. 5, 2009

(30) Foreign Application Priority Data

Sep. 4, 2007 (JP) ..... 2007-229313
Jun. 19, 2008 (JP) ..... 2008-160602

(51) Int. Cl.
*B31F 7/00* (2006.01)

(52) U.S. Cl.
USPC ..... 493/419; 493/420; 493/434; 493/442

(58) Field of Classification Search
CPC ..... B65H 45/142; B65H 45/12; B65H 45/14; B65H 45/144; B65H 45/148; B31B 19/36
USPC ..... 493/419, 420, 421, 434, 435, 442
See application file for complete search history.

(56) References Cited

U.S. PATENT DOCUMENTS 1,716,936 A * 6/1929 Waterworth ..... 493/421
2,230,168 A * 1/1941 Spiess ..... 493/421
3,511,013 A * 5/1970 Pahlitzsch ..... 53/412
4,225,128 A * 9/1980 Holyoke ..... 493/421
4,484,905 A * 11/1984 Ashburner ..... 493/415
4,850,945 A * 7/1989 Whittenberger ..... 493/14
4,917,366 A 4/1990 Murakami et al.
RE34,338 E * 8/1993 Beck et al. ..... 156/217
5,242,364 A 9/1993 Lehmann
5,556,086 A * 9/1996 Munneke et al. ..... 270/46
6,206,816 B1 * 3/2001 Cook et al. ..... 493/420
2007/0176357 A1 8/2007 Horio et al.

FOREIGN PATENT DOCUMENTS

EP 0 511 488 11/1992
JP 60-015358 1/1985
JP 62-68973 4/1987

(Continued)

OTHER PUBLICATIONS

Abstract of JP 2002-332159 published Nov. 22, 2002.

(Continued)

*Primary Examiner* — Sameh H. Tawfik
(74) *Attorney, Agent, or Firm* — Harness, Dickey & Pierce P.L.C.

(57) ABSTRACT

Plural conveying paths including guide plates are arranged on both sides of a sheet in its thickness direction, being linked from an upstream side to a downstream side in a conveying direction of the sheet. A stopper is arranged in at least one of the conveying paths to make contact with a leading edge of the sheet conveyed through the conveying paths thereby stopping the sheet and forming a bending portion at the sheet. A pair of folding rollers is arranged between the conveying paths to nip the bending portion of the sheet to form a folding line at the sheet. An adjusting member is provided on the guide plates to adjust a space between the guide plates.

17 Claims, 14 Drawing Sheets

(56) References Cited

FOREIGN PATENT DOCUMENTS

| | | |
|---|---|---|
| JP | 62-196249 | 8/1987 |
| JP | 04-064577 | 2/1992 |
| JP | 09-118468 | 5/1997 |
| JP | 2002-332159 | 11/2002 |
| JP | 2004-352421 | 12/2004 |
| JP | 2005-225675 | 8/2005 |
| JP | 3791348 | 4/2006 |
| JP | 2006-327765 | 12/2006 |

OTHER PUBLICATIONS

Office Action dated Apr. 7, 2010 for corresponding Chinese Application No. 200810215150.9 and English translation thereof.

Office Action dated Jun. 12, 2012 issued in corresponding Japanese Application No. 2008-160602.

* cited by examiner

SINGLE FOLD

Z FOLD

OUTSIDE
TRIPLE FOLD

INSIDE
TRIPLE FOLD

SIMPLE
QUADRUPLE FOLD

GATE FOLD

SKEW CORRECTION

FIRST TIME ABUTTING OF LEADING END (PASSING FOLDING OPERATION AT FIRST NIP OF FOLDING ROLLERS)

FOLDING OPERATION AT SECOND NIP OF FOLDING ROLLERS

SECOND TIME ABUTTING OF LEADING END FOLDING OPERATION AT THIRD NIP OF FOLDING ROLLERS

SHEET DISCHARGING

SKEW CORRECTION

FIRST TIME ABUTTING OF LEADING END

FOLDING OPERATION AT FIRST NIP OF FOLDING ROLLERS

SECOND TIME ABUTTING OF LEADING END

SHEET DISCHARGING (PASSING FOLDING OPERATION AT THIRD NIP OF FOLDING ROLLERS)

SKEW CORRECTION

FIRST TIME ABUTTING OF LEADING END

FOLDING OPERATION AT FIRST NIP OF FOLDING ROLLERS

SECOND TIME ABUTTING OF LEADING END (PRESSING LEADING END IN FOLDING DIRECTION BY FLIP PREVENTING MEMBER)

SHEET DISCHARGING (PASSING FOLDING OPERATION AT THIRD NIP OF FOLDING ROLLERS)

SKEW CORRECTION

FIRST TIME ABUTTING OF LEADING END

FOLDING OPERATION AT FIRST NIP OF FOLDING ROLLERS

SECOND TIME ABUTTING OF LEADING END

SHEET DISCHARGING (PASSING FOLDING OPERATION AT THIRD NIP OF FOLDING ROLLERS)

SECOND TIME ABUTTING OF LEADING END FOLDING OPERATION AT SECOND NIP OF FOLDING ROLLERS

THIRD TIME ABUTTING OF LEADING END FOLDING OPERATION AT THIRD NIP OF FOLDING ROLLERS (PRESSING LEADING END IN FOLDING DIRECTION BY FLIP PREVENTING MEMBER)

SHEET DISCHARGING

SHEET FOLDING DEVICE AND IMAGE FORMING APPARATUS

CROSS-REFERENCE TO RELATED APPLICATIONS

The present application claims priority to and incorporates by reference the entire contents of Japanese priority document 2007-229313 filed in Japan on Sep. 4, 2007 and Japanese priority document 2008-160602 filed in Japan on Jun. 19, 2008.

BACKGROUND OF THE INVENTION

1. Field of the Invention

The present invention relates to a technology for performing a sheet folding operation by conveying a recording medium through a plurality of conveying paths.

2. Description of the Related Art

Japanese Utility Model Application Laid-open No. S62-68973 and Japanese Patent Application Laid-open No. H04-64577 disclose a sheet folding device that performs a folding operation such as an operation of folding a recording medium (hereinafter, "sheet") in a Z fold. In such a sheet folding device, when a sheet is conveyed in a first conveying path toward a pair of folding rollers, the leading end of the sheet is brought into contact with a first stopper in the first conveying path, so that a portion of the sheet is bent by the first stopper. The bending portion is then conveyed between the folding rollers whereby a first folding operation is performed on the sheet to fold the sheet. The folded sheet is then conveyed toward a second stopper in a second conveying path, and the same process as in the first conveying path is performed in the second conveying path, so that a second folding operation is performed on the sheet to fold the sheet again. Each of the first conveying path and the second conveying path is formed by guide plates arranged on opposite sides of the sheet in a thickness direction.

However, in the sheet folding device described above, a space between the guide plates in the first conveying path is the same as that in the second conveying path, and the size of the space is not particularly specified for each of the first conveying path and the second conveying path. When the above folding operation is performed on a sheet, the sheet passing through each of the conveying paths has a different thickness, and every time the folding operation is performed on the sheet, the thickness of the sheet is increased. Specifically, the sheet passing through the first conveying path has the thickness of the original sheet because the folding operation has not been performed on the sheet yet. The sheet passing through the second conveying path has the thickness of double the original sheet because the sheet has been folded. Thus, because the thickness of the sheet is increased after the folding operation, a problem can occur if the space between the guide plates is the same in the first conveying path and the second conveying path. If the space between the guide plates is larger than the thickness of the sheet, it is difficult to convey the sheet in a stable manner or to fold the sheet at an appropriate position. On the other hand, if the space between the guide plates is smaller than the thickness of the sheet, friction between the sheet and the guide plates is increased, and therefore the sheet can be easily jammed between the guide plates.

Japanese Patent Application Laid-open No. 2002-332159 discloses a sheet folding device in which a sheet can be folded at an appropriate position in a desired manner, and can be conveyed in a conveying path without causing a jam, by setting a space between guide plates arranged downstream of folding rollers larger than that between guide plates arranged upstream of the folding rollers.

However, some sheet folding devices include a plurality of conveying paths and a plurality of pairs of folding rollers, and perform different folding operations (single fold, Z fold, outside triple fold, inside triple fold, simple quadruple fold, and gate fold) based on sheet folding modes by using different combinations of the conveying paths. In some sheet folding modes (folding operations), the thickness of a sheet conveyed through a conveying path arranged upstream of the folding rollers is the same as that in a conveying path arranged downstream of the folding rollers. In other sheet folding modes, however, the thickness of a sheet is changed (increased) when the sheet is conveyed from the conveying path arranged upstream of the folding rollers to the conveying path arranged downstream of the folding rollers. Therefore, even if the space between the guide plates arranged downstream of the folding rollers is larger than that between the guide plates arranged upstream of the folding rollers as disclosed in Japanese Patent Application Laid-open No. 2002-332159, it is difficult to convey a sheet in a smooth manner.

SUMMARY OF THE INVENTION

It is an object of the present invention to at least partially solve the problems in the conventional technology.

According to an aspect of the present invention, there is provided a sheet folding device including a plurality of conveying paths for conveying a sheet, each including guide plates arranged on both sides of the sheet in its thickness direction, the conveying paths being linked from an upstream side to a downstream side in a conveying direction of the sheet; a stopper that is arranged in at least one of the conveying paths and is configured to make contact with a leading edge of the sheet conveyed through the conveying paths thereby stopping the sheet and forming a bending portion at the sheet; a pair of folding rollers that is arranged between the conveying paths, and nips the bending portion of the sheet to form a folding line at the sheet; and an adjusting member that is provided on the guide plates to adjust a space between the guide plates.

Furthermore, according to another aspect of the present invention, there is provided an image forming apparatus including a sheet folding device that includes a plurality of conveying paths for conveying a sheet, each including guide plates arranged on both sides of the sheet in its thickness direction, the conveying paths being linked from an upstream side to a downstream side in a conveying direction of the sheet; a stopper that is arranged in at least one of the conveying paths and is configured to make contact with a leading edge of the sheet conveyed through the conveying paths thereby stopping the sheet and forming a bending portion at the sheet; a pair of folding rollers that is arranged between the conveying paths, and nips the bending portion of the sheet to form a folding line at the sheet; and an adjusting member that is provided on the guide plates to adjust a space between the guide plates.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
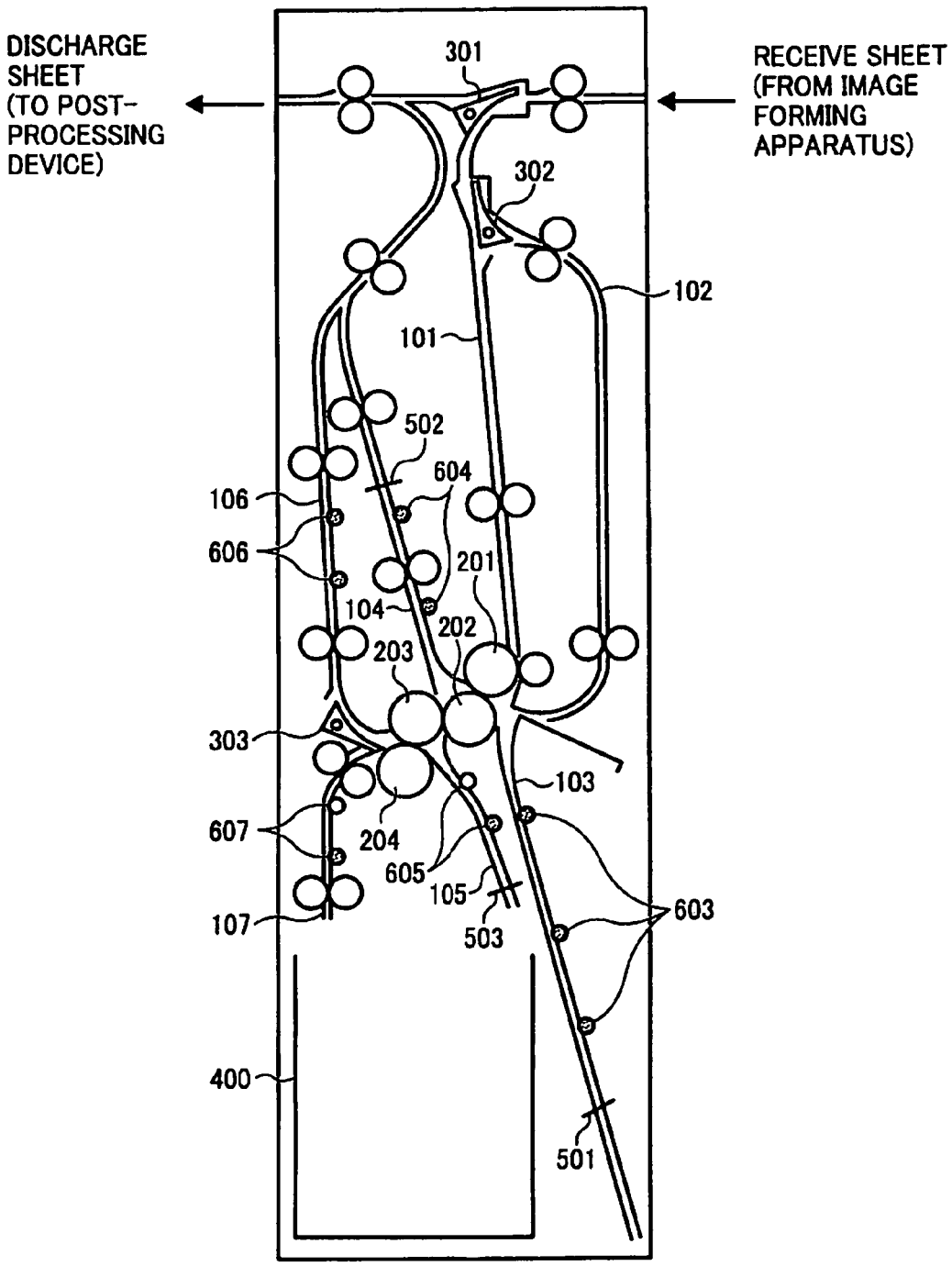
FIG. 1 is a schematic diagram of a sheet folding device according to a first embodiment of the present invention.
Figure 2A:
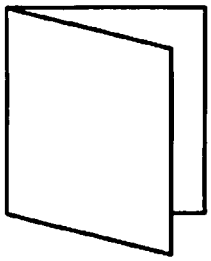
FIGS. 2A to 2F are schematic diagrams for explaining sheet folding modes according to the first embodiment.
Figure 2B:
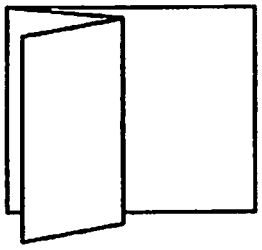
Figure 2C:
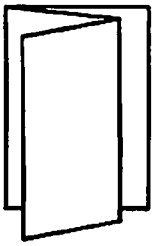
Figure 2D:
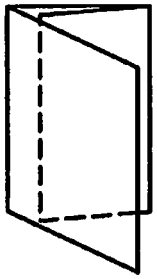
Figure 2E:
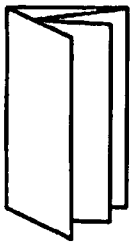
Figure 2F:
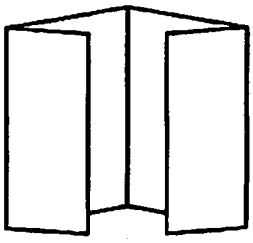

FIG. 1 is a schematic diagram of a sheet folding device according to a first embodiment of the present invention. The sheet folding device receives a recording medium (hereinafter, "sheet") on which an image is formed from an image forming apparatus (not shown), and then performs a predetermined folding operation on the sheet. Afterward, if post-processing, such as punching or stapling, is to be performed on the sheet by a post-processing device (not shown), the sheet folding device discharges the sheet toward the post-processing device. If the post-processing is not to be performed on the sheet, the sheet folding device causes the sheet to be stacked in a stacker 400 arranged in the sheet folding device.

The sheet folding device includes a first conveying path 101, a second conveying path 102, a third conveying path 103, a fourth conveying path 104, a fifth conveying path 105, a sixth conveying path 106, and a seventh conveying path 107 through which a sheet is conveyed. Each of the conveying paths 101 to 107 is formed by guide plates that are arranged on opposite sides of a sheet in its thickness direction with a predetermined space between the guide plates. The guide plates are arranged to guide a sheet conveyed through each of the conveying paths 101 to 107. The conveying paths 101 to 107 are directly connected, or are connected through a pair of folding rollers. A first stopper 501, a second stopper 502, and a third stopper 503 are arranged in the third conveying path 103, the fourth conveying path 104, and the fifth conveying path 105, respectively. When a sheet is conveyed to each of the conveying paths 103 to 105, the leading end of the sheet is brought into contact with each of the stoppers 501 to 503 whereby each of the stoppers 501 to 503 stops the sheet.

FIGS. 2A to 2F are schematic diagrams for explaining sheet folding modes (a single fold mode, a Z fold mode, an outside triple fold mode, an inside triple fold mode, a simple quadruple fold mode, and a gate fold mode) according to the first embodiment. With the above configuration, the sheet folding device performs a folding operation in each of the sheet folding modes.

FIGS. 3A to 3E are schematic diagrams of the sheet folding device for explaining a folding operation in the single fold mode. FIGS. 4A to 4E are schematic diagrams of the sheet folding device for explaining a folding operation in the Z fold mode. FIGS. 5A to 5E are schematic diagrams of the sheet folding device for explaining a folding operation in the outside triple fold mode. FIGS. 6A to 6E are schematic diagrams of the sheet folding device for explaining a folding operation in the inside triple fold mode. FIGS. 7A to 7E are schematic diagrams of the sheet folding device for explaining a folding operation in the simple quadruple fold mode. FIGS. 8A to 8F are schematic diagrams of the sheet folding device for explaining a folding operation in the gate fold mode.

Figure 3A:
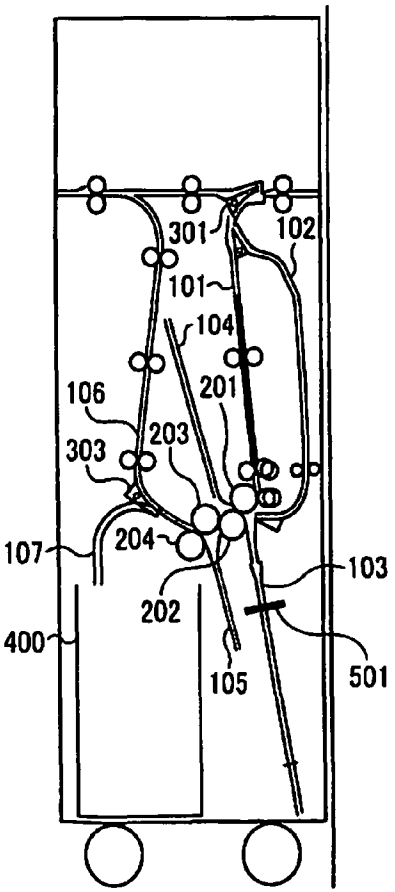
FIGS. 3A to 3E are schematic diagrams of the sheet folding device for explaining a folding operation in a single fold mode.
Figure 3B:
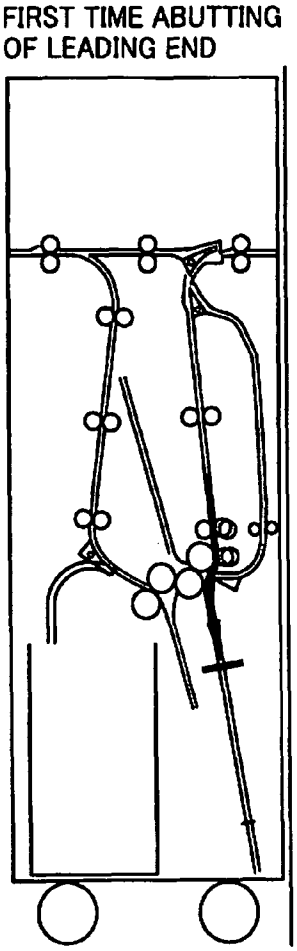
Figure 3C:
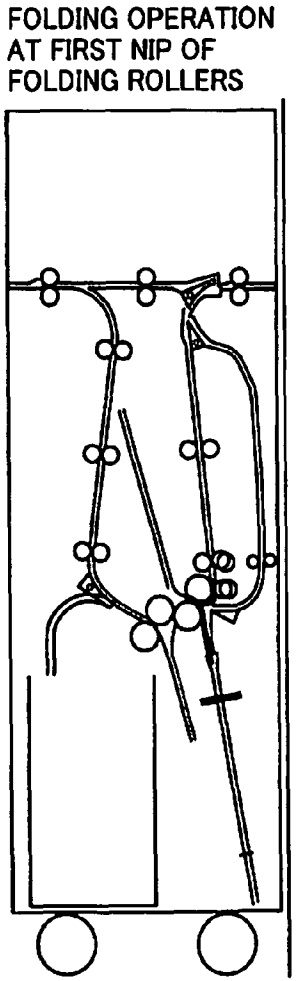

When the sheet folding device receives a sheet from the image forming apparatus, the sheet is guided to the first conveying path 101 by a first switching claw 301 (FIG. 3A). The sheet is then guided to the third conveying path 103, so that the leading end of the sheet is brought into contact with the first stopper 501 that is movable depending on a fold position of the sheet (FIG. 3B). When the leading end of the sheet is brought into contact with the first stopper 501, a portion of the sheet is bent. The bending portion is then conveyed through a nip (a first nip) formed between a first folding roller 201 and a second folding roller 202 whereby a first folding operation is performed on the sheet. Thus, the single fold operation is completed (FIG. 3C).

Figure 3D:
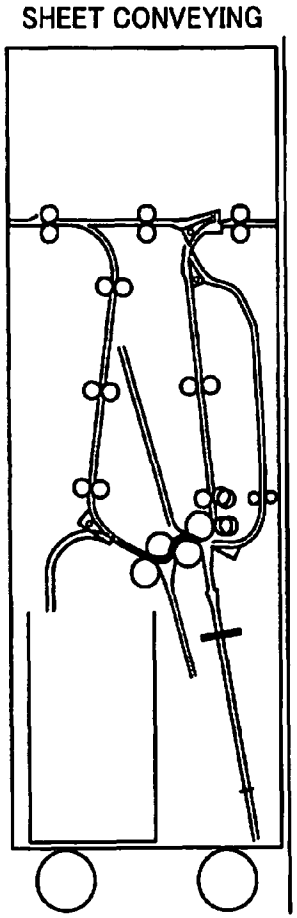

After the single fold operation is completed, the sheet is conveyed through a nip (a second nip) formed between the second folding roller 202 and a third folding roller 203, and a nip (a third nip) formed between the third folding roller 203 and a fourth folding roller 204 without entering the fourth conveying path 104 (FIG. 3D). The folding operation is not performed on the sheet at the second nip and the third nip.

Figure 3E:
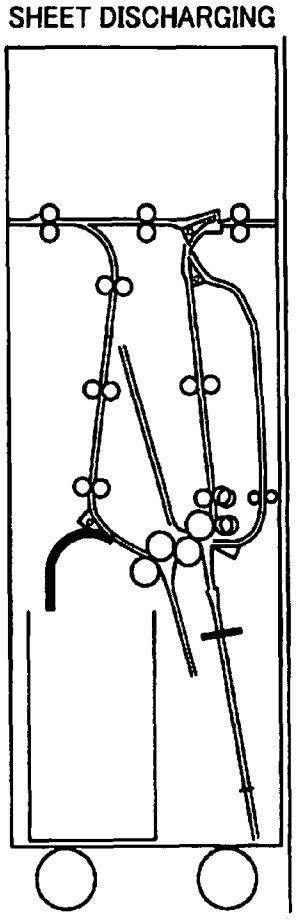

The sheet is then guided to the seventh conveying path 107 by a third switching claw 303, and is stacked in the stacker 400 (FIG. 3E). If the post-processing is to be performed on the sheet after the folding operation is performed, the sheet is conveyed through the second nip and the third nip without entering the fourth conveying path 104, and is guided to the sixth conveying path 106 by the third switching claw 303, so that the sheet is conveyed toward the post-processing device. Alternatively, the sheet can be conveyed toward the post-processing device through the fourth conveying path 104 after the first folding operation is performed by the first folding roller 201 and the second folding roller 202 (in such a case, the second stopper 502 is removed from the fourth conveying path 104).

Figure 4A:
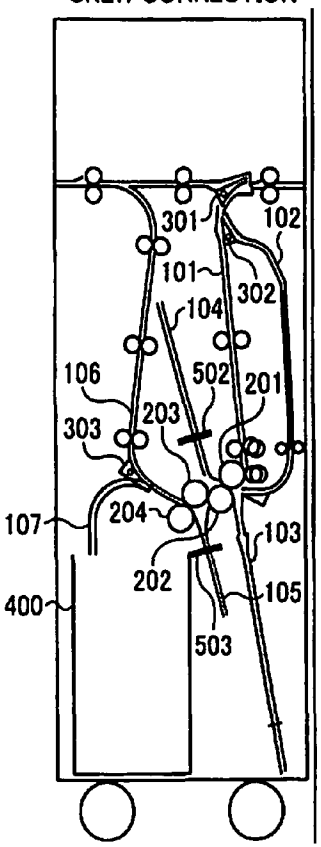
FIGS. 4A to 4E are schematic diagrams of the sheet folding device for explaining a folding operation in a Z fold mode.
Figure 4B:
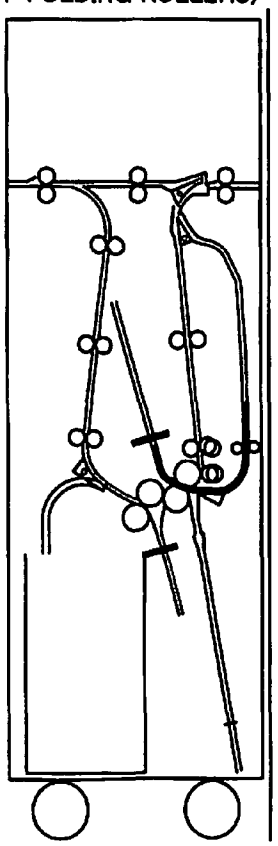
Figure 4C:
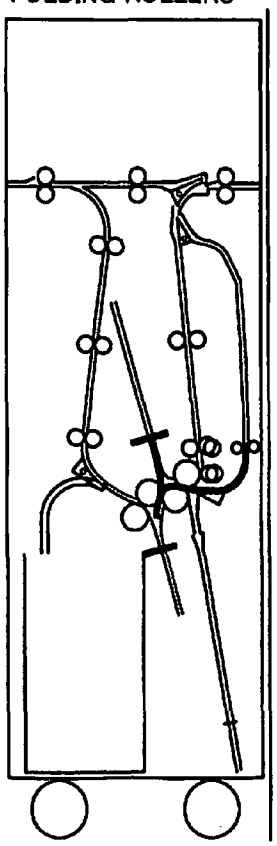

When the sheet folding device receives a sheet from the image forming apparatus, the sheet is guided to the second conveying path 102 by the first switching claw 301 and a second switching claw 302 (FIG. 4A). The sheet is conveyed through the first nip, and is then guided to the fourth conveying path 104, so that the leading end of the sheet is brought into contact with the second stopper 502 that is movable depending on a fold position of the sheet (FIG. 4B). When the leading end of the sheet is brought into contact with the second stopper 502, a portion of the sheet is bent. The bending portion is conveyed through the second nip whereby a first folding operation is performed on the sheet (FIG. 4C).

Figure 4D:
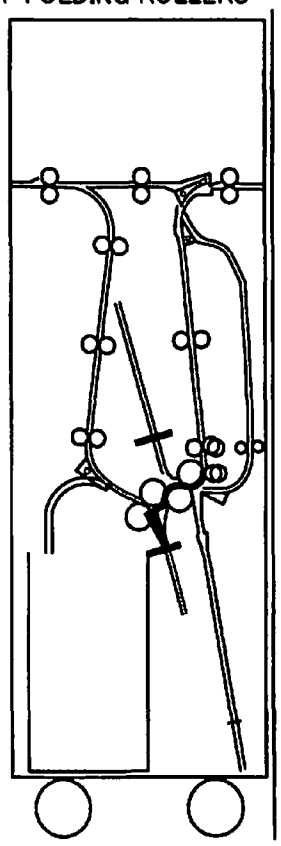

Then, the sheet is guided to the fifth conveying path 105, so that the leading end of the sheet is brought into contact with the third stopper 503 that is movable depending on a fold position of the sheet. When the leading end of the sheet is brought into contact with the third stopper 503, a portion of the sheet is bent. The bending portion is conveyed through the third nip whereby a second folding operation is performed on the sheet (FIG. 4D). Thus, the Z fold operation is completed.

Figure 4E:
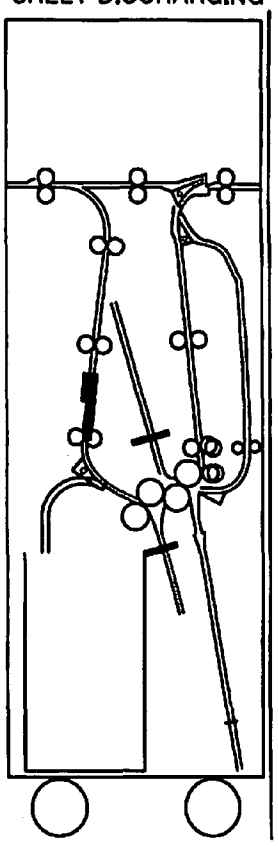

After the Z fold operation is completed, the sheet is guided to the seventh conveying path 107 by the third switching claw 303, and is stacked in the stacker 400. Alternatively, if the post-processing (punching, stapling, shifting, or mixed size stacking) is to be performed on the sheet after the folding operation is performed, the sheet is guided to the sixth conveying path 106 by the third switching claw 303, and is conveyed toward the post-processing device (FIG. 4E).

Figure 5A:
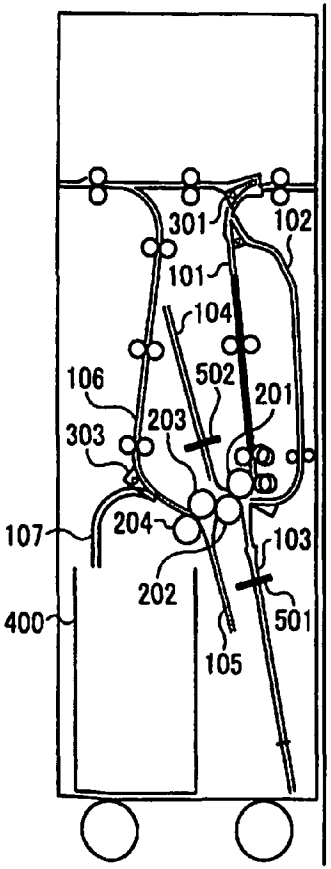
FIGS. 5A to 5E are schematic diagrams of the sheet folding device for explaining a folding operation in an outside triple fold mode.
Figure 5B:
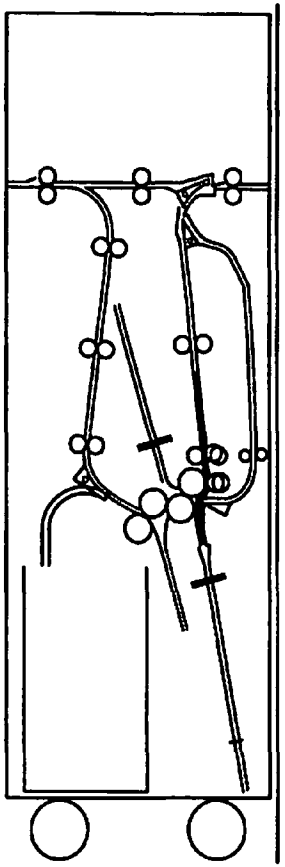
Figure 5C:
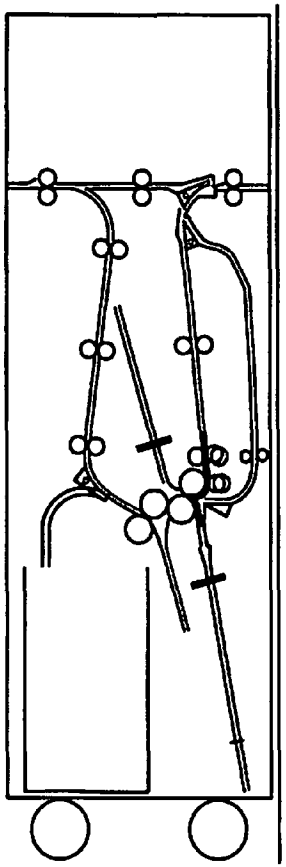

When the sheet folding device receives a sheet from the image forming apparatus, the sheet is guided to the first conveying path 101 by the first switching claw 301 (FIG. 5A). The sheet is then guided to the third conveying path 103, so that the leading end of the sheet is brought into contact with the first stopper 501 (FIG. 5B). When the leading end of the sheet is brought into contact with the first stopper 501, a portion of the sheet is bent. The bending portion is then conveyed through the first nip whereby a first folding operation is performed on the sheet (FIG. 5C).

Figure 5D:
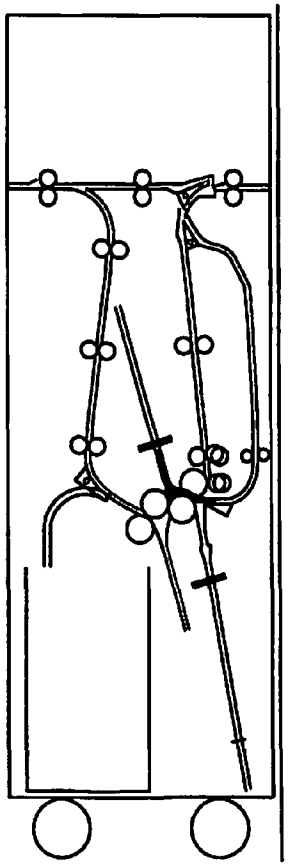

Then, the sheet is guided to the fourth conveying path 104, so that the leading end of the sheet is brought into contact with the second stopper 502. When the leading end of the sheet is brought into contact with the second stopper 502, a portion of the sheet is bent. The bending portion is then conveyed through the second nip whereby a second folding operation is performed on the sheet (FIG. 5D). Thus, the outside triple fold operation is completed.

Figure 5E:
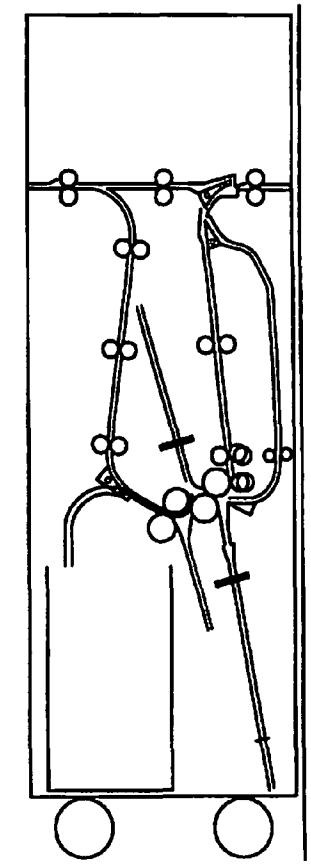
Figure 6A:
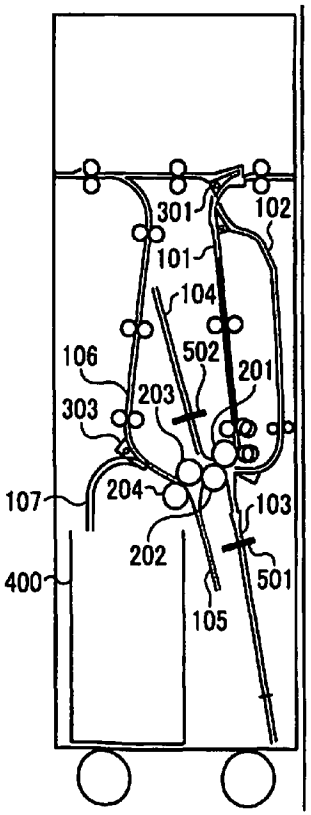
FIGS. 6A to 6E are schematic diagrams of the sheet folding device for explaining a folding operation in an inside triple fold mode.
Figure 6B:
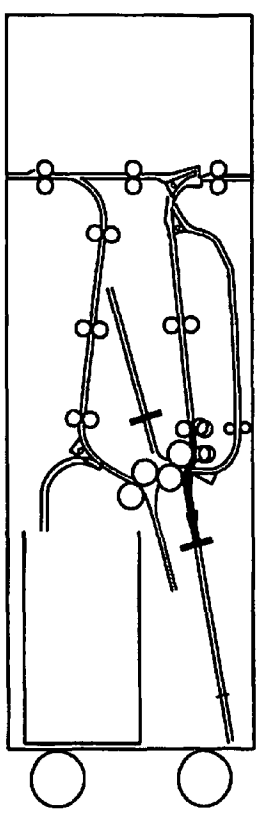
Figure 6C:
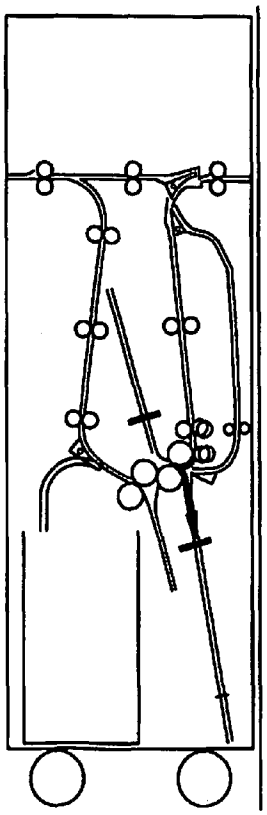
Figure 6D:
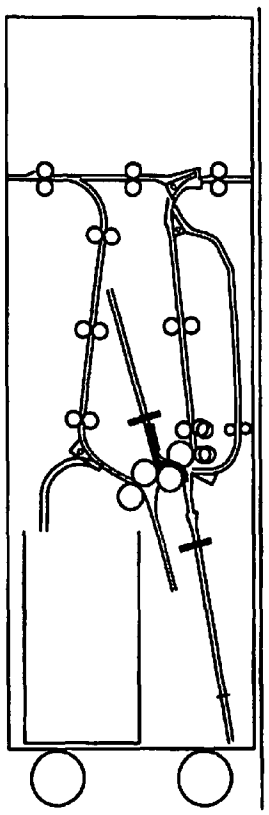
Figure 6E:
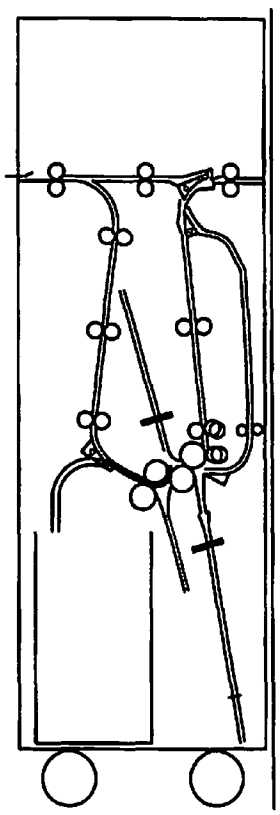
Figure 7A:
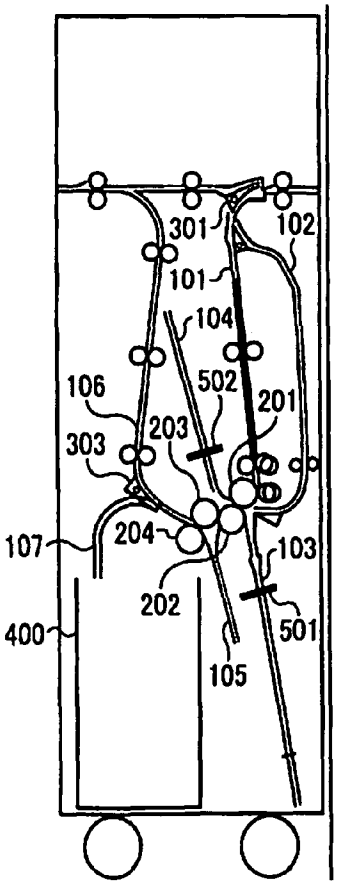
FIGS. 7A to 7E are schematic diagrams of the sheet folding device for explaining a folding operation in a simple quadruple fold mode.
Figure 7B:
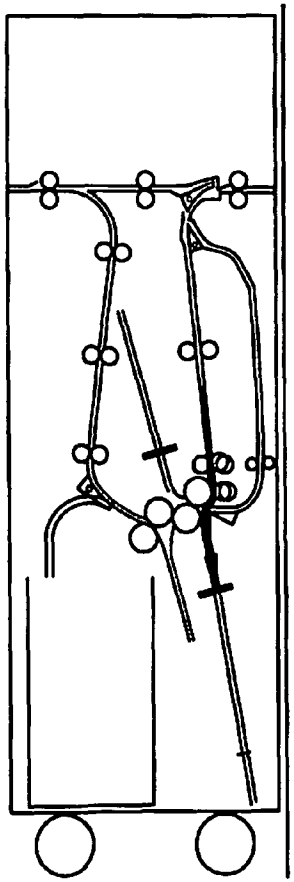
Figure 7C:
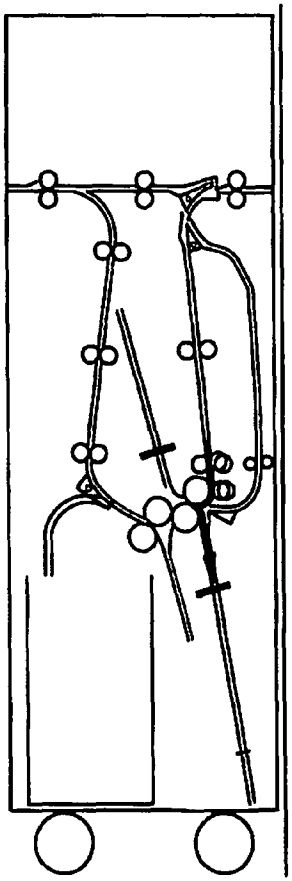
Figure 7D:
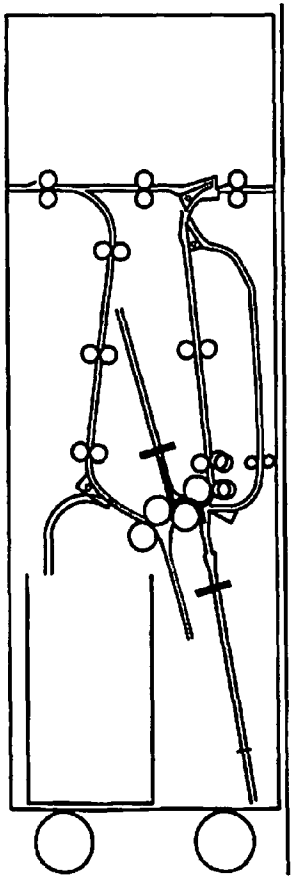
Figure 7E:
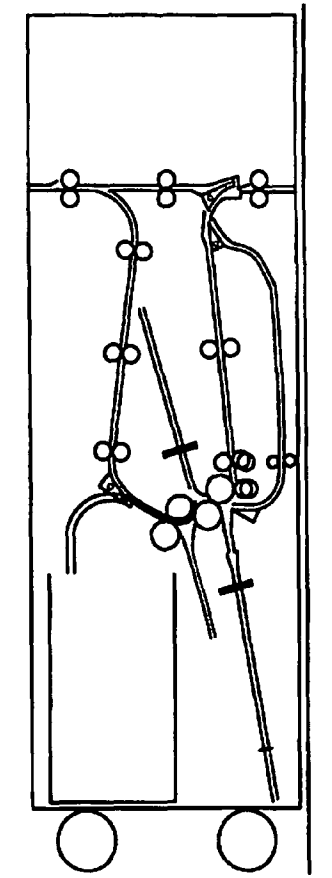

After the outside triple fold operation (an inside triple fold operation or a simple quadruple fold operation) is completed, the sheet is conveyed through the third nip without entering the fifth conveying path 105 (FIG. 5E). Then, the sheet is guided to the seventh conveying path 107 by the third switching claw 303, and is stacked in the stacker 400. Alternatively, if the post-processing is to be performed on the sheet after the folding operation is performed, the sheet is conveyed through the third nip, and is guided to the sixth conveying path 106 by the third switching claw 303, so that the sheet is conveyed toward the post-processing device.

The inside triple fold operation and the simple quadruple fold operation are performed in almost the same manner as the outside triple fold operation, and therefore detailed explanation on the inside triple fold operation and the simple quadruple fold operation is omitted. Each of the processes shown in FIGS. 6A to 6E and FIGS. 7A to 7E corresponds to that shown in FIGS. 5A to 5E. In the inside triple fold operation and the simple quadruple fold operation, the sheet is conveyed through the same conveying paths as in the outside triple fold operation, and the folding operation is performed at the same nip as in the outside triple fold operation. The difference between the outside triple fold operation, the inside triple fold operation, and the simple quadruple fold operation is a fold position of the sheet in the first folding operation. The fold position can be adjusted by changing the position of the first stopper 501. A fold position of the sheet in the second folding operation is determined depending on the fold position in the first folding operation, and the second folding operation is performed on a corresponding fold position of the sheet.

Figure 8A:
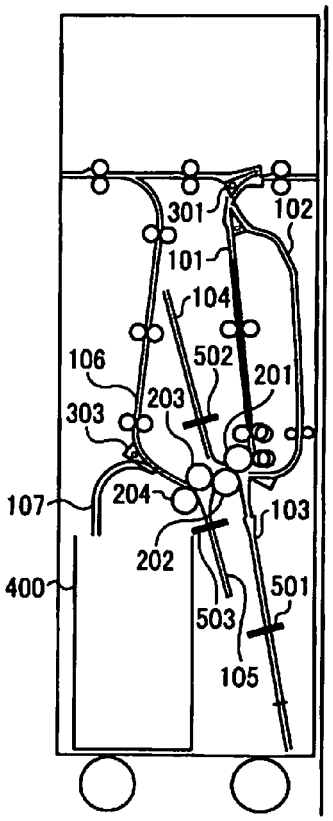
FIGS. 8A to 8F are schematic diagrams of the sheet folding device for explaining a folding operation in a gate fold mode.
Figure 8B:
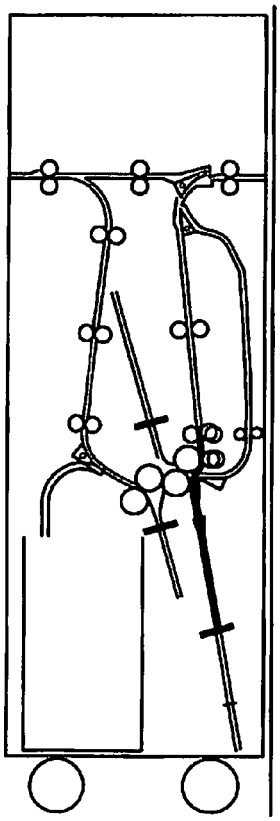
Figure 8C:
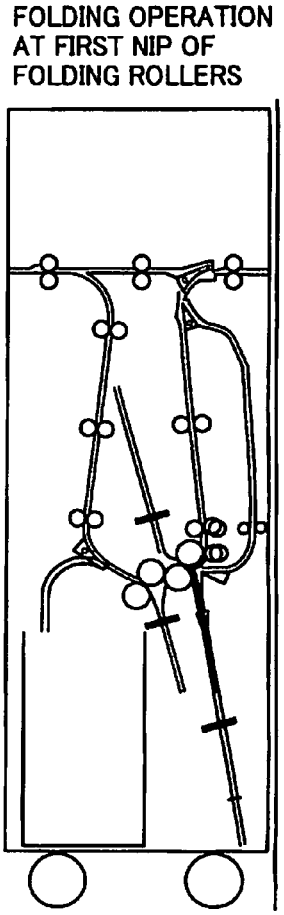

When the sheet folding device receives a sheet from the image forming apparatus, the sheet is guided to the first conveying path 101 by the first switching claw 301 (FIG. 8A). The sheet is then guided to the third conveying path 103, so that the leading end of the sheet is brought into contact with the first stopper 501 (FIG. 8B). When the leading end of the sheet is brought into contact with the first stopper 501, a portion of the sheet is bent. The bending portion is then conveyed through the first nip whereby a first folding operation is performed on the sheet (FIG. 8C).

Figure 8D:
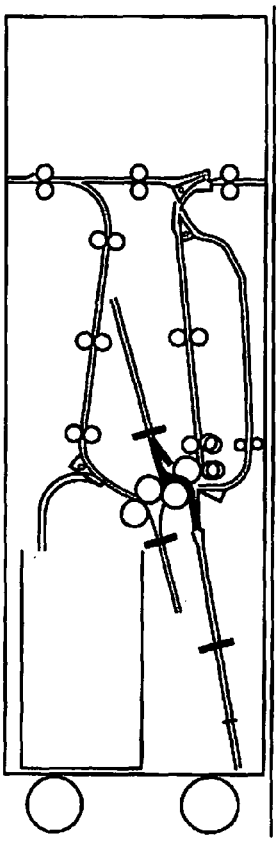

Then, the sheet is guided to the fourth conveying path 104, so that the leading end of the sheet is brought into contact with the second stopper 502. When the leading end of the sheet is brought into contact with the second stopper 502, a portion of the sheet is bent. The bending portion is then conveyed through the second nip whereby a second folding operation is performed on the sheet (FIG. 8D).

Figure 8E:
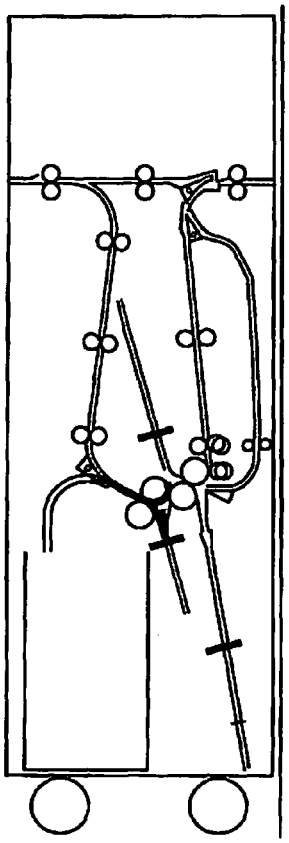

Then, the sheet is guided to the fifth conveying path 105, so that the leading end of the sheet is brought into contact with the third stopper 503. When the leading end of the sheet is brought into contact with the third stopper 503, a portion of the sheet is bent. The bending portion is then conveyed through the third nip whereby a third folding operation is performed on the sheet. Thus, the gate fold operation is completed (FIG. 8E).

Figure 8F:
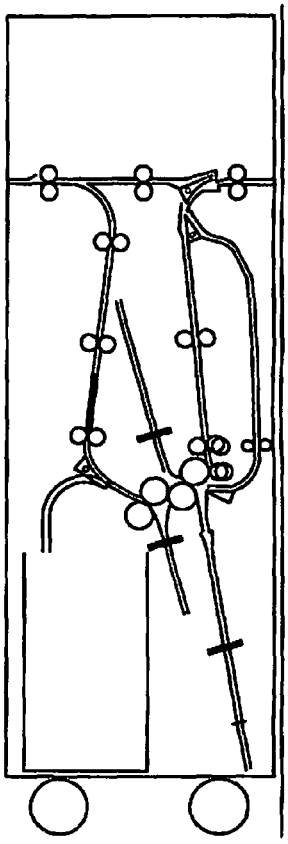

After the gate fold operation is completed, the same operation as in the Z fold operation is performed. Specifically, the sheet is guided to the seventh conveying path 107 by the third switching claw 303, and is stacked in the stacker 400. Alternatively, if the post-processing is to be performed on the sheet, the sheet is guided to the sixth conveying path 106 by the third switching claw 303, and is conveyed toward the post-processing device (FIG. 8F).

A first idler roller 603, a second idler roller 604, a third idler roller 605, a fourth idler roller 606, and a fifth idler roller 607 are arranged in the third conveying path 103, the fourth conveying path 104, the fifth conveying path 105, the sixth conveying path 106, and the seventh conveying path 107, respectively. The idler rollers 603 to 607 serve as adjusting members that adjust a space between the guide plates. The adjusting member is not limited to the idler roller, but can be a Mylar.

Figure 9:
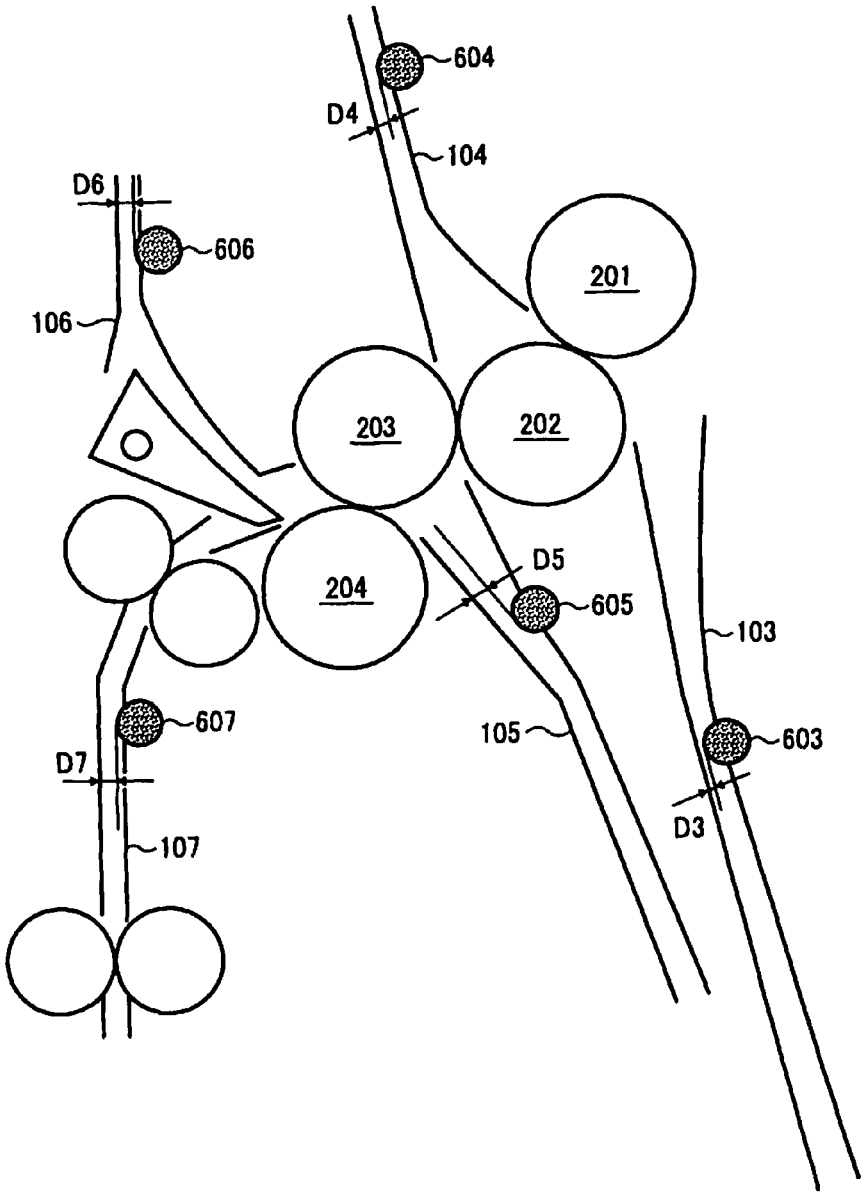
FIG. 9 is an enlarged view of a relevant part of the sheet folding device for explaining arrangement of idler rollers.

FIG. 9 is an enlarged view of a relevant part of the sheet folding device for explaining arrangement of the idler rollers 603 to 607. The third conveying path 103 is adjusted to have a space D3 by the first idler roller 603, the fourth conveying path 104 is adjusted to have a space D4 by the second idler roller 604, the fifth conveying path 105 is adjusted to have a space D5 by the third idler roller 605, the sixth conveying path 106 is adjusted to have a space D6 by the fourth idler roller 606, and the seventh conveying path 107 is adjusted to have a space D7 by the fifth idler roller 607.

Table 1 indicates that the thickness of a sheet conveyed through each of the conveying paths 103 to 107 is different depending on the sheet folding mode.

TABLE 1

| | Single fold | Z fold | Outside triple fold | Inside triple fold | Simple quadruple fold | Gate fold |
|---|---|---|---|---|---|---|
| Third conveying path 103 | Sheet thickness × 1 | Not conveyed | Sheet thickness × 1 | Sheet thickness × 1 | Sheet thickness × 1 | Sheet thickness × 1 |
| Fourth conveying path 104 | Sheet thickness × 2 | Sheet thickness × 1 | Sheet thickness × 2 | Sheet thickness × 2 | Sheet thickness × 2 | Sheet thickness × 2 |
| Fifth conveying path 105 | Not conveyed | Sheet thickness × 2 | Not conveyed | Not conveyed | Not conveyed | Sheet thickness × 2 |
| Sixth conveying path 106 | Sheet thickness × 2 | Sheet thickness × 3 | Not conveyed | Not conveyed | Not conveyed | Not conveyed |
| Seventh conveying path 107 | Sheet thickness × 2 | Sheet thickness × 3 | Sheet thickness × 3 | Sheet thickness × 3 | Sheet thickness × 4 | Sheet thickness × 4 |

The thickness of a sheet conveyed through the conveying path arranged downstream of the folding rollers is equal to or larger than that of the sheet conveyed through the conveying path arranged upstream of the folding rollers. If the space between the guide plates is the same in all of the conveying paths 103 to 107, in some conveying paths, the sheet can be conveyed between the guide plates in an unstable manner because of the large space, and in other conveying paths, the sheet can be jammed between the guide plates because of the small space. Thus, it is difficult to convey the sheet in a smooth manner. To solve the above problem, the idler rollers are arranged in the conveying paths upstream and downstream of the folding rollers to adjust the space between the guide plates. With this configuration, it is possible to convey the sheet in a stable manner.

The idler rollers are arranged such that the space between the guide plates downstream of the folding rollers is equal to or larger than that between the guide plates upstream of the folding rollers. Thus, it is possible to convey a folded sheet in a stable manner.

The space defined by each of the idler rollers 603 to 607 is determined based on the thickness of a sheet conveyed through each of the conveying paths 103 to 107. In this manner, it is possible to provide an appropriate space in each of the conveying paths 103 to 107 with respect to the thickness of the conveyed sheet.

Specifically, the idler rollers 603 to 607 are arranged such that the spaces defined by the idler rollers 603 to 607 are set as follows:

The third conveying path 103: D3=sheet thickness×1

The fourth conveying path 104: D4=sheet thickness×2

The fifth conveying path 105: D5=sheet thickness×2

The sixth conveying path 106: D6=sheet thickness×4

The seventh conveying path 107: D7=sheet thickness×4

Thus, the space defined by each of the idler rollers 603 to 607 corresponds to a maximum thickness of a sheet conveyed through each of the conveying paths 103 to 107, so that it is possible to prevent the possibility that the sheet hits the idler rollers 603 to 607 and gets jammed between the guide plates, and to convey the sheet in a smooth manner in all of the sheet folding modes.

However, the thickness of a sheet conveyed through each of conveying paths is different depending on the sheet folding mode. Specifically, in the Z fold operation, the thickness of the sheet conveyed through the fourth conveying path 104 is sheet thickness×1 (because it is an unfolded sheet), and if the space D4 is set to sheet thickness×2, the space D4 is larger than the thickness of the sheet. Therefore, it is difficult to convey the sheet in a stable manner. To solve such a problem, the idler rollers are movable in a direction perpendicular to a conveying direction of the sheet. With this configuration, it is possible to provide an appropriate space in each of the conveying paths depending on the thickness of a conveyed sheet.

The sheet having sheet thickness×1 or sheet thickness×2 is conveyed through the fourth conveying path 104 depending on the sheet folding mode. On the other hand, the sheet having sheet thickness×2, sheet thickness×3 or sheet thickness×4 is conveyed through the seventh conveying path 107 depending on the sheet folding mode. If a moving distance of each of the idler rollers is the same, the space can be too small in some conveying paths, and can be too large in other conveying paths with respect to the thickness of the sheet. Therefore, the moving distance of each of the idler rollers 603 to 607 is individually set, so that it is possible to provide an appropriate space in each of the conveying paths.

However, in some conveying paths, the sheet having the same thickness is conveyed in all of the sheet folding modes. If a mechanism for moving the idler roller is arranged in all of the conveying paths, the mechanisms become complicated, and the costs are increased. Therefore, the idler roller is not movable in the conveying path through which the sheet having the same thickness is conveyed in all of the sheet folding modes, and the idler roller is movable in the conveying path through which the sheet having a different thickness is conveyed depending on the sheet folding mode. Specifically, the idler rollers 603 and 605 are not movable. In this manner, it is possible to omit an unnecessary mechanism, and to reduce the costs.

Furthermore, because the thickness of the sheet conveyed through each of the conveying paths is different depending on the sheet folding mode, the idler rollers are individually moved in the conveying paths, and the moving distance of each of the idler rollers is determined based on the sheet folding mode. In this manner, an appropriate space can be provided in each of the conveying paths depending on the sheet folding mode, and the sheet can be conveyed in a stable manner in all of the sheet folding modes.

Figure 10:
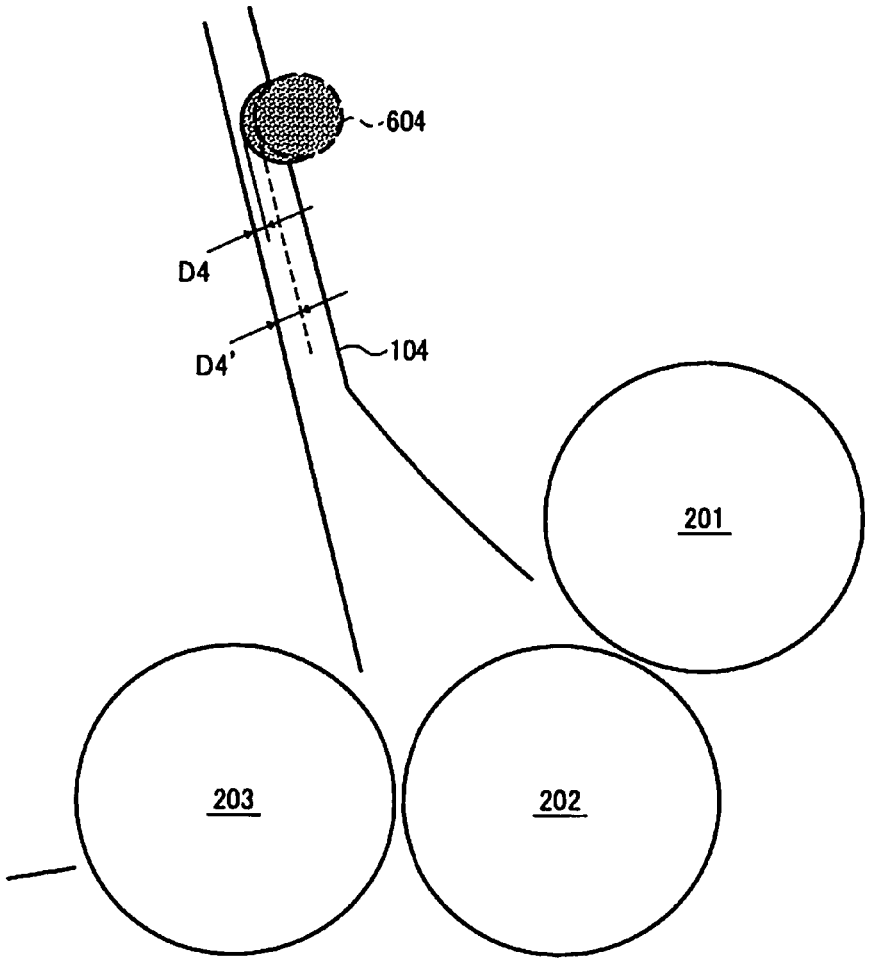
FIG. 10 is an enlarged view of a relevant part of the sheet folding device for explaining an operation of adjusting a space between guide plates.

FIG. 10 is an enlarged view of a relevant part of the sheet folding device for explaining an operation of adjusting the space between the guide plates by moving the second idler roller 604. When the Z fold operation is performed on the sheet, the second idler roller 604 is moved in a direction close to the guide plate that is opposed to the second idler roller 604, thereby defining the space D4. When the single fold operation is performed on the sheet, the second-idler roller 604 is moved in a direction away from the guide plate that is opposed to the second idler roller 604, thereby forming the space D4'.

Specifically, the space in each of the conveying paths 103 to 107 is defined as follows:

[Single Fold]

The third conveying path 103: D3=sheet thickness×1
The fourth conveying path 104: D4=sheet thickness×2
The fifth conveying path 105: arbitrary (not conveyed)
The sixth conveying path 106: D6=sheet thickness×2
The seventh conveying path 107: D7=sheet thickness×2

[Z Fold]

The third conveying path 103: arbitrary (not conveyed)
The fourth conveying path 104: D4=sheet thickness×1
The fifth conveying path 105: D5=sheet thickness×2
The sixth conveying path 106: D6=sheet thickness×3
The seventh conveying path 107: D7=sheet thickness×3

[Outside Triple Fold, Inside Triple Fold]

The third conveying path 103: D3=sheet thickness×1
The fourth conveying path 104: D4=sheet thickness×2
The fifth conveying path 105: arbitrary (not conveyed)
The sixth conveying path 106: arbitrary (not conveyed)
The seventh conveying path 107: D7=sheet thickness×3

[Simple Quadruple Fold]

The third conveying path 103: D3=sheet thickness×1
The fourth conveying path 104: D4=sheet thickness×2
The fifth conveying path 105: arbitrary (not conveyed)
The sixth conveying path 106: arbitrary (not conveyed)
The seventh conveying path 107: D7=sheet thickness×4

[Gate Fold]

The third conveying path 103: D3=sheet thickness×1
The fourth conveying path 104: D4=sheet thickness×2
The fifth conveying path 105: D5=sheet thickness×2
The sixth conveying path 106: arbitrary (not conveyed)
The seventh conveying path 107: D7=sheet thickness×4

Figure 11:
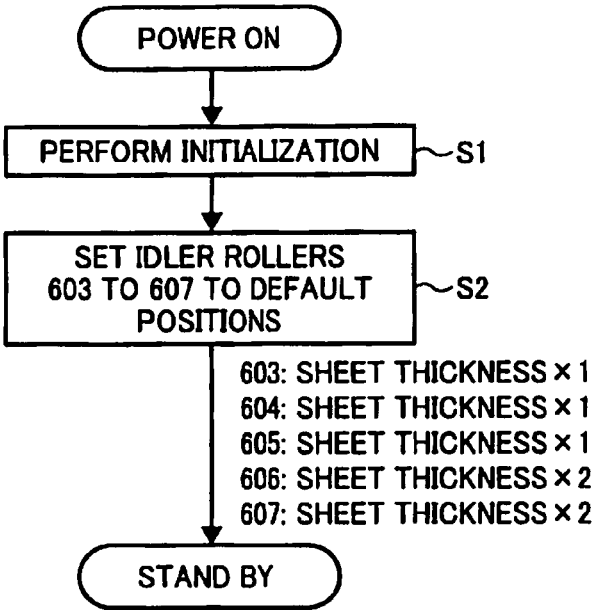
FIGS. 11 and 12 are flowcharts for explaining an operation of adjusting the space in each of conveying paths in the sheet folding device.
Figure 12:
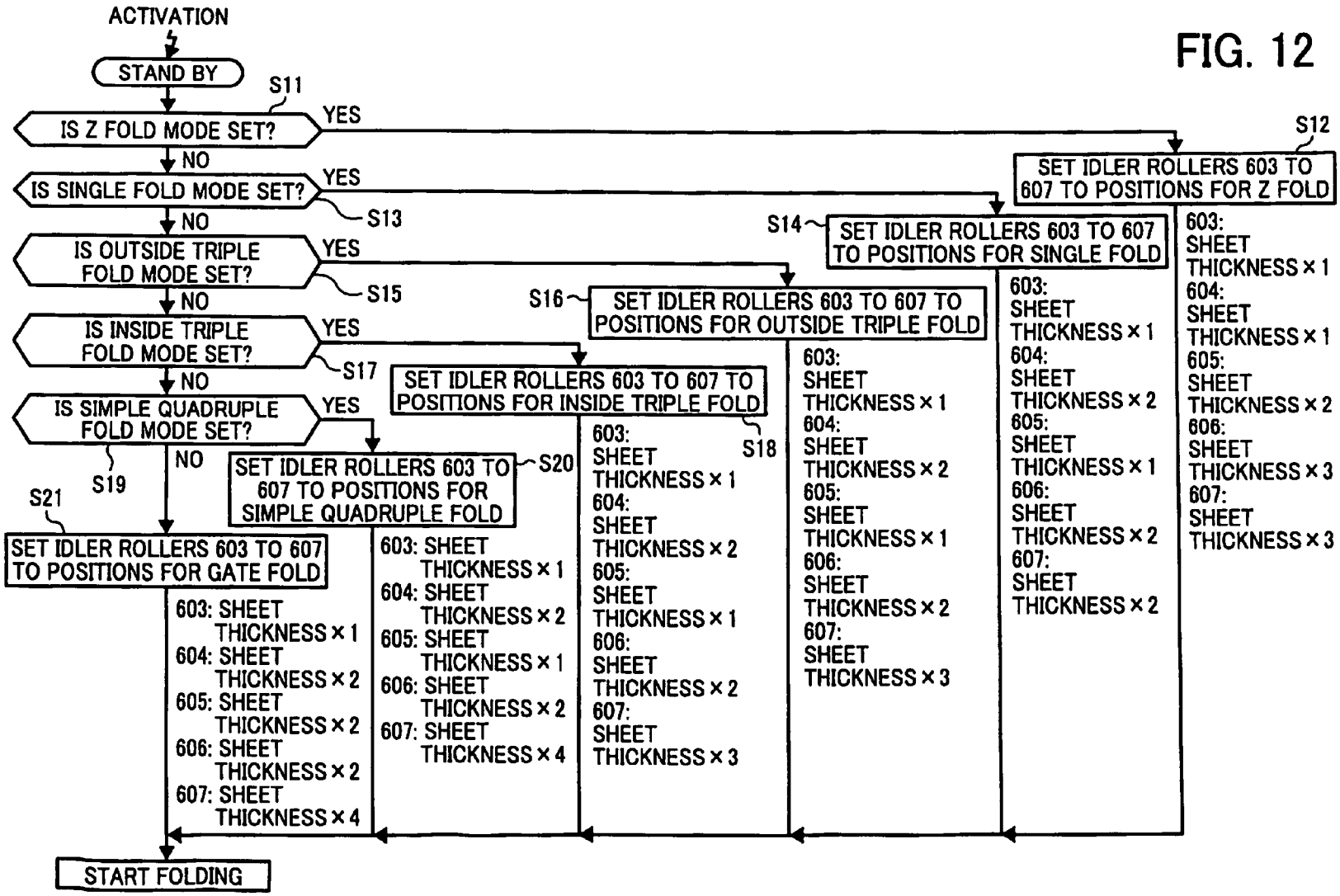

FIGS. 11 and 12 are flowcharts for explaining an operation of adjusting the space in each of the conveying paths 103 to 107 by changing positions of the idler rollers 603 to 607. After a power source (not shown) is turned on, initialization is performed (Step S1). The idler rollers 603 to 607 are set to default positions (Step S2), and then enter a standby state. Specifically, the default positions of the idler rollers 603 to 607 are defined such that the space D3=sheet thickness×1, the space D4=sheet thickness×1, the space D5=sheet thickness×1, the space D6=sheet thickness×2, and the space D7=sheet thickness×2.

After a function of setting the sheet folding mode is activated, a set sheet folding mode and positions of the idler rollers 603 to 607 corresponding to the set sheet folding mode are determined. When the idler rollers 603 to 607 are set to these positions, the folding operation is started. For example, if the outside triple fold mode is set (No at Step S11, No at Step S13, and Yes at Step S15), the idler rollers 603 to 607 are set to the corresponding positions for the outside triple fold mode (Step S16).

Specifically, the idler rollers 603 to 607 are set to the positions such that the space D3=sheet thickness×1, the space D4=sheet thickness×2, the space D5=sheet thickness×1, the space D6=sheet thickness×2, and the space D7=sheet thickness×3. The positions of the idler rollers 603 to 607 as shown in FIG. 12 are determined based on the thickness of a sheet conveyed through each of the conveying paths 103 to 107 as shown in Table 1 and the space in each of the conveying paths 103 to 107 as described above.

With the configuration and the operation described above, it is possible to convey the folded sheet in a stable manner.

Figure 13:
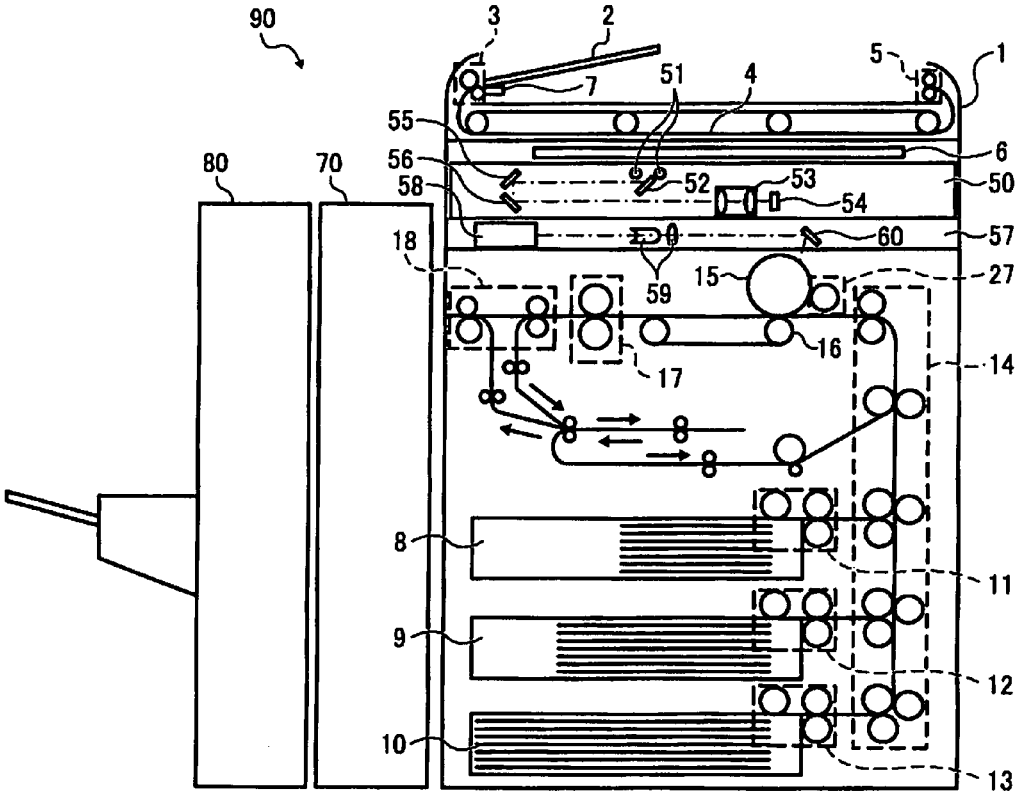
FIG. 13 is a schematic diagram of an image forming apparatus according to a second embodiment of the present invention.

FIG. 13 is a schematic diagram of an image forming apparatus 90 according to a second embodiment of the present invention. The image forming apparatus 90 includes a sheet folding device 70 having the configuration according to the first embodiment and a post-processing device 80. The image forming apparatus 90 is a copy machine that forms a toner image by an image forming process using an electrophotographic system. The image forming apparatus 90 can be a printer, a facsimile, or a multifunction product (MFP) having functions of a copy machine, a printer, and a facsimile. The image forming apparatus 90 can be an inkjet printer.

The image forming apparatus 90 includes an automatic document feeder (ADF) 1, a feed tray 2, feeding rollers 3, a feeding belt 4, ejecting rollers 5, an exposure glass 6, an original-set detecting unit 7, a first tray 8, a second tray 9, a third tray 10, a first feeding unit 11, a second feeding unit 12, a third feeding unit 13, a longitudinal conveying unit 14, a photosensitive element 15, a conveying belt 16, a fixing unit 17, a discharging unit 18, a developing unit 27, a scanning unit 50 including an exposure lamp 51, a first mirror 52, a lens 53, a coupled charge device (CCD) image sensor 54, a second mirror 55, and a third mirror 56, a writing unit 57 including a laser output unit 58, an imaging lens 59, and a mirror 60, the sheet folding device 70, and the post-processing device 80.

A pile of originals are placed on the feed tray 2 such that the side of the original on which an image is formed faces upward. When a start key of an operation unit (not shown) is pressed, the uppermost original is fed from the pile by the feeding rollers 3 and the feeding belt 4 to a predetermined position on the exposure glass 6.

When the original is fed to the predetermined position on the exposure glass 6, the image on the original is scanned by the scanning unit 50. After the scanning is completed, the original is ejected to the outside by the feeding belt 4 and the ejecting rollers 5. When the original-set detecting unit 7 detects that the next original is placed on the feed tray 2, the next original is fed to a predetermined position on the exposure glass 6 in the same manner as described above. The feeding rollers 3, the feeding belt 4, and the ejecting rollers 5 are driven by a conveying motor (not shown).

Sheets stacked on the first tray 8, the second tray 9, and the third tray 10 are fed by the first feeding unit 11, the second feeding unit 12, and the third feeding unit 13, respectively, and are conveyed by the longitudinal conveying unit 14 to a position at which the sheet is in contact with the photosensitive element 15.

The photosensitive element 15 is irradiated with a laser beam emitted from the writing unit 57 based on image data obtained by the scanning unit 50 whereby an electrostatic latent image is formed on the photosensitive element 15. The electrostatic latent image on the photosensitive element 15 is developed by the developing unit 27, so that a toner image is formed on the photosensitive element 15.

After the sheet is conveyed to the conveying belt 16 by the longitudinal conveying unit 14, the sheet is conveyed by the conveying belt 16 that is moved at the same speed as that at which the photosensitive element 15 is rotated, so that the toner image on the photosensitive element 15 is transferred onto the sheet.

The sheet having the toner image transferred thereon is then conveyed to the fixing unit 17 where the toner image is fixed to the sheet with heat.

The photosensitive element 15, the conveying belt 16, the fixing unit 17, the discharging unit 18, and the developing unit 27 are driven by a main motor (not shown). Each of the feeding units 11 to 13 is driven by a driving force transmitted from the main motor via a feeding clutch (not shown). The longitudinal conveying unit 14 is driven by a driving force transmitted from the main motor via an intermediate clutch (not shown).

The discharging unit 18 discharges the sheet having the image formed thereon to the sheet folding device 70. The sheet folding device 70 performs the folding operation as described in the first embodiment. After the sheet folding device 70 completes the folding operation, the sheet folding device 70 discharges the sheet to the post-processing device 80. The post-processing device 80 performs post-processing operation, such as sorting of sheets for each original or each copy of originals that is sorted by an image memory, punching, or stapling.

The above embodiments are described as preferred embodiments of the present invention. The present invention is not limited to the embodiments, but modifications can be made as appropriate within a scope of technical ideas of the present invention.

According to the embodiments, an adjusting member is arranged between guide plates of each of conveying paths arranged upstream and downstream of folding rollers to adjust a space between the guide plates, so that it is possible to convey a sheet in a stable manner.

Furthermore, according to the embodiments, the space between the guide plates arranged downstream of the folding rollers is equal to or larger than the space between the guide plates arranged upstream of the folding rollers, so that it is possible to convey a folded sheet in a stable manner.

Moreover, according to the embodiments, the space is determined depending on the thickness of a sheet conveyed through each of the conveying paths, so that it is possible to provide an appropriate space in each of the conveying paths with respect to the thickness of the sheet.

Furthermore, according to the embodiments, the space corresponds to a maximum thickness of a sheet conveyed through each of the conveying paths, so that it is possible to convey the sheet in a smooth manner without being hit by the adjusting member.

Moreover, according to the embodiments, the adjusting member is movable in a direction perpendicular to a conveying direction of a sheet by a driving source, so that the adjusting member can be moved in accordance with change of the thickness of the sheet depending on the sheet folding mode, and an appropriate space can be provided in the conveying path.

Furthermore, according to the embodiments, a moving distance of the adjusting member in the direction perpendicular to the conveying direction is individually set for each of the conveying paths, so that an appropriate space can be provided in each of the conveying paths.

Moreover, according to the embodiments, the adjusting member only in the conveying path through which a sheet having a different thickness is conveyed is movable in the direction perpendicular to the conveying direction, so that it is possible to omit an unnecessary mechanism for moving the adjusting member, and to reduce the costs.

Furthermore, according to the embodiments, a moving distance of the adjusting member in the direction perpendicular to the conveying direction is determined depending on the sheet folding mode, so that an appropriate space can be provided in each of the conveying paths depending on each of the sheet folding modes, and to convey the sheet in a stable manner in all of the sheet folding modes.

Moreover, according to the embodiments, an idler roller or a Mylar can be used as the adjusting member, so that it is possible to convey a sheet without causing damage on the sheet.

According to an aspect of the present invention, it is possible to provide a sheet folding device and an image forming apparatus in which a sheet can be conveyed through each of the conveying paths in a stable manner.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A device for folding a sheet, comprising:

a plurality of conveying paths for conveying a sheet, each including guide plates arranged on both sides of the sheet in its thickness direction, the conveying paths being linked from an upstream side to a downstream side in a conveying direction of the sheet;

a stopper that is arranged in each of the conveying paths and is configured to make contact with a leading edge of the sheet conveyed through the conveying paths thereby stopping the sheet and forming a bending portion at the sheet;

a pair of folding rollers that is arranged between the conveying paths, and nips the bending portion of the sheet to form a folding line at the sheet; and an adjusting member that is provided on the respective guide plates for each of the plurality of conveying paths, wherein the adjusting member adjusts the space between the guide plates before the sheet contacts the adjusting member, wherein the adjusting member is arranged in the respective conveying paths of at least one of an upstream side and a downstream side of the folding rollers to adjust the space between the guide plates and to convey the sheet in a stable manner, wherein the adjusting member is movable in a direction perpendicular to the respective conveying path of the sheet in which the sheet having a different thickness is conveyed, and wherein a moving distance of the adjusting member is determined based on folding modes in which different folding operations are performed by using combination of the conveying paths to provide an appropriate space in each of the conveying paths and convey the folded sheet in a stable manner.

2. The device according to claim 1, wherein the conveying paths includes a first conveying path through which a first sheet that is unfolded is conveyed;

a second conveying path that is linked to the first conveying path and includes a first stopper that is configured to make contact with a leading edge of the first sheet conveyed from the first conveying path thereby stopping the first sheet;

a third conveying path that is linked to the second conveying path through a first pair of folding rollers that nips, when the first sheet is stopped and bent by the first stopper, a bending portion of the first sheet, so that a second sheet having a first fold is conveyed from the first pair of folding rollers to the third conveying path, the third conveying path including a second stopper that is configured to make contact with a leading edge of the second sheet conveyed from the first pair of folding rollers thereby stopping the second sheet;

a fourth conveying path that is linked to the third conveying path through a second pair of folding rollers that nips, when the second sheet is stopped and bent by the second stopper, a bending portion of the second sheet, so that a third sheet having the first fold and a second fold is conveyed from the second pair of folding rollers to the fourth conveying path, the fourth conveying path including a third stopper that is configured to make contact with a leading edge of the third sheet conveyed from the second pair of folding rollers thereby stopping the third sheet; and a fifth conveying path that is linked to the fourth conveying path through a third pair of folding rollers that nips, when the third sheet is stopped and bent by the third stopper, a bending portion of the third sheet, so that a fourth sheet having the first fold, the second fold, and a third fold is conveyed from the third pair of folding rollers to the fifth conveying path.

3. The device according to claim 1, wherein a space between the guide plates in a conveying path arranged downstream of the folding rollers is equal to or larger than a space between the guide plates in a conveying path arranged upstream of the folding rollers.

4. The device according to claim 1, wherein the space between the guide plates is determined based on a thickness of a sheet conveyed through each of the conveying paths.

5. The device according to claim 1, wherein the space between the guide plates corresponds to a maximum thickness of a sheet conveyed through each of the conveying paths.

6. The device according to claim 1, wherein the adjusting member is configured to move in a direction perpendicular to a conveying direction of the sheet.

7. The device according to claim 6, wherein the moving distance of the adjusting member is individually set for each of the conveying paths.

8. The device according to claim 1, wherein the adjusting member includes an idler roller.

9. The device according to claim 1, wherein the adjusting member includes a Mylar.

10. The device according to claim 1, wherein at least two adjusting members associated with different conveying paths are configured to be adjusted to provide different spaces before a folding operation begins based on the selected folding mode.

11. The device according to claim 10, wherein the different spaces are provided by moving the at least two adjusting members different amounts.

12. The device according to claim 11, wherein the adjusting member that is moved a greater amount is downstream from the adjusting member that is moved a lesser amount.

13. The device according to claim 11, wherein the different amounts are determined before the paper contacts either of the at least two adjusting members.

14. The device according to claim 1, wherein the adjusting member is configured to contact the sheet and is further configured to adjust the space between the guide plates before the sheet contacts adjusting member.

15. An image forming apparatus, comprising:

a sheet folding device that includes:

a plurality of conveying paths for conveying a sheet, each including guide plates arranged on both sides of the sheet in its thickness direction, the conveying paths being linked from an upstream side to a downstream side in a conveying direction of the sheet;

a stopper that is arranged in each of the conveying paths and is configured to make contact with a leading edge of the sheet conveyed through the conveying paths thereby stopping the sheet and forming a bending portion at the sheet;

a pair of folding rollers that is arranged between the conveying paths, and nips the bending portion of the sheet to form a folding line at the sheet; and an adjusting member that is provided on the respective guide plates for each of the plurality of conveying paths, wherein the adjusting member adjusts the space between the guide plates before the sheet contacts the adjusting member, wherein the adjusting member is arranged in the respective conveying paths of at least one of an upstream side and a downstream side of the folding rollers to adjust the space between the guide plates and to convey the sheet in a stable manner, wherein the adjusting member is movable in a direction perpendicular to the respective conveying path of the sheet in which the sheet having a different thickness is conveyed depending on a selected sheet folding mode, and wherein a moving distance of the adjusting member is determined based on folding modes in which different folding operations are performed by using combination of the conveying paths to provide an appropriate space in each of the conveying paths and convey the folded sheet in a stable manner.

16. The image forming apparatus according to claim 15, wherein the adjusting member is arranged in a default position before a folding mode is selected and is configured to move to a set position after the folding mode is selected and before a folding operation begins.

17. The image forming apparatus according to claim 16, wherein the folding mode is one of a Z fold, a single fold, a triple fold, and a quadruple fold.

* * * * *